United States Patent [19]

White et al.

[11] 4,351,156

[45] Sep. 28, 1982

[54] COMBUSTION SYSTEMS

[75] Inventors: David J. White, San Diego; Peter B. Roberts, Encinitas, both of Calif.

[73] Assignee: International Harvester Company, Chicago, Ill.

[21] Appl. No.: 110,784

[22] Filed: Jan. 9, 1980

Related U.S. Application Data

[62] Division of Ser. No. 930,249, Aug. 2, 1978.

[51] Int. Cl.[3] ..... F02C 7/224; F23R 3/32

[52] U.S. Cl. ..... 60/737; 60/747; 60/750; 60/760

[58] Field of Search ..... 60/737, 747, 750, 760

[56] References Cited

U.S. PATENT DOCUMENTS

| | | | |
|---|---|---|---|
| 2,885,858 | 5/1959 | Lloyd | 60/760 |
| 3,153,323 | 10/1964 | Hamm | 60/737 |
| 4,073,134 | 2/1978 | Koch | 60/747 |
| 4,192,139 | 3/1980 | Buchheim | 60/750 |
| 4,194,358 | 3/1980 | Stenger | 60/747 |

OTHER PUBLICATIONS

Roberts et al., "Advanced Low $NO_x$ Combustors for Supersonic High-Altitude Aircraft Gas Turbines", NASA Paper CR-134889, Nov. 1975.

White et al., "Low $NO_x$ Emission Combustor for Automobile Gas Turbine Engines", EPA Paper APT-D-1441, Feb. 1973.

*Primary Examiner*—Robert E. Garrett

*Attorney, Agent, or Firm*—LeBlanc, Nolan, Shur & Nies

[57] ABSTRACT

Combustion apparatus of the premix/fuel lean type which employ jet induced circulation to inhibit the formation of atmospheric pollutants.

7 Claims, 11 Drawing Figures

COMBUSTION SYSTEMS

This application is a division of application Ser. No. 930,249 filed Aug. 2, 1978.

The present invention relates to combustion apparatus and, more specifically, to novel, improved combustion apparatus which are efficient; which have low atmospheric pollutant levels; and which can be employed in essentially any application requiring continuous combustion and minimization of noxious emissions.

In recent years it has been recognized that oxides of nitrogen ($NO_x$) generated in the combustion of conventional fuels play an important role in the production of photochemical smog. In consequence these oxides are currently considered serious, immediate, environmental pollutants; and strict regulations limiting the emission of those oxides into the atmosphere are existent or pending on both local and federal levels.

One combustion system which has demonstrated the capability of supressing $NO_x$ emission to acceptable levels involves the injection of water into the combustor primary zone. This approach, which achieves emission reductions by lowering reaction temperatures in the primary zone, suffers from several drawbacks. Probably the primary disadvantage is a decrease in overall engine efficiency with a consequent increase in operating cost. In addition, the cost of treating the large quantities of water required is high in terms of both initial investment and maintenance. And, in many instances this approach is completely infeasible because of the complete absence of water at the site where combustion is to be effected.

Another, proprietary system which has successfully demonstrated an ability to suppress the formation of $NO_x$ in the combustion of fuels is the premix/fuel lean type jet induced circulation (JIC) combustor.

In the JIC system fuel is vaporized and mixed with primary air in external premixers of tubular configuration. These have discharge sections inclined at an angle to the centerline of and toward the upstream or dome end of a primary combustor at locations around the periphery of the combustor.

The fuel/air mixture exits as near-homogeneous jets into the reaction zone of the combustor. The separate jets impinge towards the axis of the combustor forming two derived jets. The major derived jet flows upstream into the reaction zone toward the combustor dome, impinges on the dome, and then flows rearwardly towards the fuel/air jets exiting from the premixers. The resultant recirculation pattern is anchored by the fuel/air jets with a fraction of the reaction products being entrained into the jets and acting as a continuous ignition source. The remainder of the products flow out of the reaction zone between the fuel/air jets.

The small, minor, derived jet flows rearwardly from the impingement point of the separate fuel/air jets and is reacted, partially in a secondary zone downstream of the premixer inlets to the primary combustor and partially by recirculation and entrainment into the fuel/air jets.

The secondary zone can be considered as a continuation of the reaction or primary zone; some oxidation of carbon monoxide occurs in the secondary zone.

The JIC combustor inhibits the formation of $NO_x$ by both of the mechanisms available for this purpose: reduction of local combustion reaction temperatures and reduction of oxygen concentration in the primary combustion zone.

Temperature reduction can be effected because JIC combustors are capable of maintaining flame stability even when those large amounts of excess air necessary to product a useful temperature reduction; i.e., low equivalence ratios (the actual fuel-air ratio divided by the stoichiometric fuel-air ratio) are employed. JIC combustors have been operated at equivalence ratios as low as ca. 0.26 while comparable conventional combustors become unstable at equivalence ratios only slightly below one (1.0).

The lowering of the oxygen concentration in the primary combustion zone is effected by the induced recirculation of inert combustion products to that zone to entrain the oxygen of the fuel-air mixture exiting from the premixer tubes. The recirculation of the combustion products also stabilizes the flame in the primary combustion zone. For example, by employing recirculation rates five times as high as the fuel-air mixture supply rate, which has been successfully achieved, stable operation at equivalence ratios of ca. 0.3 have been employed without producing flame instability. In other combustors, in contrast, it is difficult to obtain recirculation ratios above one.

Another important feature of JIC combustors is that the introduction of the fuel-air mixture into the combustor at a number of locations minimizes local variations in the mean equivalence ratio. This is important because only small deviations from the mean value will result in high local temperatures and drastically increased production of $NO_x$.

Low emission combustion apparatus with JIC combustors operating on the principles just discussed are disclosed in White et al, Low $NO_x$ Emission Combustor For Automobile Gas Turbine Engines, U.S. Environmental Protection Agency Report No. APTD-1441 and in Roberts et al, Advanced Low $NO_x$ Combustors For Supersonic High-Altitude Aircraft Gas Turbines, National Aeronautics And Space Administration Report No. CR 134889.

Our novel combustion apparatus disclosed herein employs jet induced circulation as described above and in the foregoing reports. However, they have a number of advantages not possessed by the combustion apparatus disclosed in those reports; and they eliminate a number of problems associated with the latter.

One important respect in which our novel combustion apparatus may differ from previously developed systems employing jet induced circulation is in the presence of a JIC compatible arrangement for heating the primary combustion air before it is introduced into the fuel-air premixers in order to insure complete vaporization of the fuel. This novel feature extends the range of fuels on which JIC combustors can be operated to those of low volatility and, also, extends the lower limit of the ambient temperature range in which such combustors can be operated without exceeding design emission limits for a given fuel.

One system we employ uses a precombustor to heat the primary combustion air before it is discharged into the premixer tubes. Both can and annular combustors in a variety of configurations can be employed.

While the $NO_x$ produced in the precombustor tends to be high, the percentage of fuel diverted to the precombustor is small. Consequently, the precombustor does not add unacceptably to the overall emission level of the combustion system in which we employ it.

We can also preheat the primary combustion air in our novel combustion systems by bleeding hot gases from the JIC combustor thereof into the primary air ports of the premixer tubes. If this approach is employed, we also preferably employ a staged fuel supply to increase the operating range of the system.

Fuel staging of combustion systems employing jet induced circulation is also an important as well as novel advance in the art. It has heretofore been proposed that variable geometry premixer tube ports be employed to increase the operating range of such systems. We, however, have found that the use of such variable geometry is impractical, at least when bleed-off of hot gases for primary combustion air preheating is employed.

Another important and novel feature of our novel combustion systems is a premixer design in which there is a co-flow of the fuel and air rather than the schemes theretofore employed—contraflow or introduction of the fuel into the primary air flow at right angles thereof. Contraflow, in particular, has been found to have serious deficiencies, the most severe being that it permits autoignition to occur in the premixer tubes. Autoignition is highly undesirable as it can cause severe damage to the equipment.

Still another important feature which may be incorporated into our novel combustion systems is the utilization of a secondary, step combustor downstream of the primary, jet induced circulation combustor to increase the operating range of the system. By employing wall recess stabilization in the secondary combustor and especially by injecting fuel into the step of the combustor as well as into the upstream end thereof, equivalence ratios which are low enough to keep $NO_x$ production within tolerable limits in the secondary combustor can be obtained.

In operation, the secondary combustor can be employed as the main combustor until the load on the combustion level reaches a selected level. At this point operation of the jet induced circulation combustor is initiated and the rate at which the fuel is supplied to the secondary combustor reduced. This has the advantage, coupled with an extended operating range, that the secondary combustor need not be operated at a level at which the production of $NO_x$ reaches an unacceptable rate. At the same time the carbon monoxide level is kept low by burnout of this compound in the secondary combustor. Thus, even under high loads, the emissions of the novel two-stage combustion system just described can be kept at low levels.

Also, extension of the operating range can be obtained simply by simultaneous operation of the primary and secondary combustors. For complex reasons that are not fully understood, those functions which stabilize the combustion process are automatically transferred to the secondary combustor when the primary combustor reaches its lean limit equivalence ratio; that is, the point at which jet induced circulation alone becomes ineffective to stabilize combustion.

Heretofore proposed combustion systems employing jet induced circulation have utilized convective and film cooling to keep the combustor walls from overheating. This technique was selected to minimize cooling air requirements and, also, to avoid quenching the conversion reactions of unburned hydrocarbons and carbon monoxide to innocuous, non-pollutants.

We have now found that the cooling techniques just described are inadequate, especially in combustion systems employing secondary step combustors in accord with the principles of the present invention. We have accordingly developed, and consider an important feature that may be incorporated into such systems, an improved cooling arrangement therefor. In general this arrangement includes a double walled combustor liner providing a passage through which cooling air can be circulated and trip strips or the like in the passage to promote the transfer of heat to the cooling air.

It is the primary object of the present invention to provide novel, improved combustion apparatus or systems of the premix/fuel lean type which employ jet induced circulation combustors of the character described above.

Other important, but more specific objects of the invention are to provide combustion apparatus or systems as identified in the primary object:

which have a wider operating range than heretofore proposed combustion apparatus employing jet induced circulation;

which, in conjunction with the preceding object, employ a staged fuel supply or staged combustors to obtain the extended range of operation;

which, in conjunction with the preceding object, have either multiple, primary JIC combustors operating in parallel or serially arranged JIC and secondary combustors;

which are capable of operating on a wider variety of fuels than the heretofore proposed apparatus;

which are capable of operating under more severe ambient temperature conditions than the heretofore proposed apparatus;

in which, in conjunction with the two preceding objects, the stated goal is realized by preheating primary combustion air supplied to the system either by the use of a precombustor or by the bleed-off of hot gases from the system;

which have an improved arrangement for premixing the fuel and primary air supplied to the system;

which have various combinations of the foregoing features and attributes.

Other important objects, advantages, and features of the present invention will be apparent to the reader from the foregoing and the appended claims and as the ensuing detailed discussion and description of our invention proceeds in conjunction with the accompanying drawing, in which:

Figure 1:
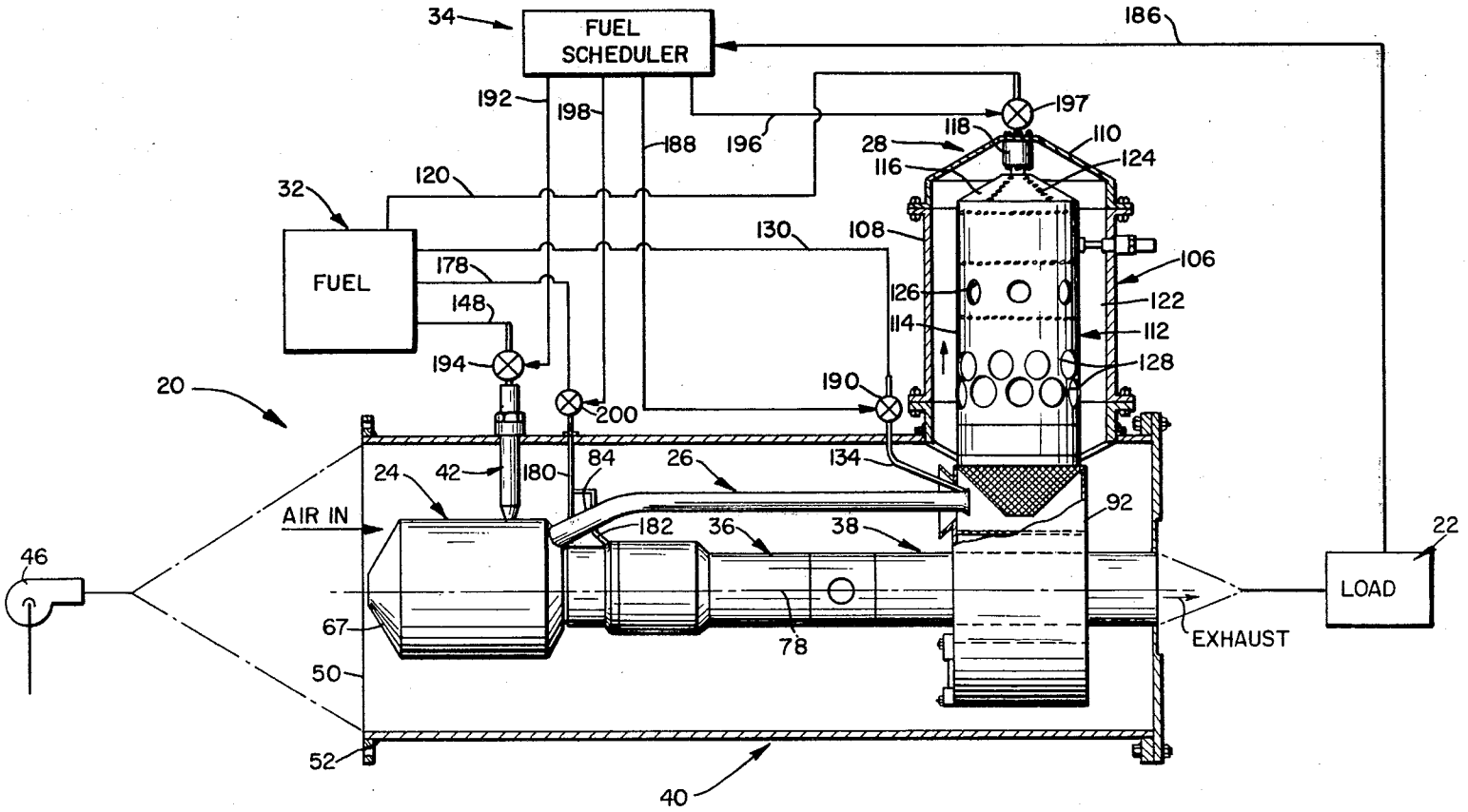
FIG. 1 is a primarily schematic illustration of a system embodying low emission combustion apparatus in accord with the principles of the present invention.

Referring now to the drawing, FIG. 1 depicts combustion apparatus 20 in accord with the principles of the present invention for supplying hot gases to a load 22 which may be a turbine, a space heating system, a jet impingement heat treatment device, an incinerator, a process heater, or the load in any other type of continuous combustion process where minimized emission of atmospheric pollutants is wanted.

The major components of combustion apparatus 20 include a main combustor 24 of the jet induced circulation type; premixers 26 for supplying a premixed mixture of fuel and air to the main combustor; a can-type precombustor 28 in which primary air supplied to the premixers is first heated to promote vaporization of fuel supplied to the premixers from fuel source 32 under the control of fuel scheduler 34; a secondary combustor 36; and a linear assembly 38 providing a dilution zone 39 downstream from the secondary combustor, all housed in a casing assembly 40.

The remaining major components of the system illustrated in FIG. 1 include a torch igniter 42 and an arrangement for effecting a flow of combustion and cooling air into casing assembly 40 and then to precombustor 28, main combustor 24, secondary combustor 36, and the dilution zone 39 in liner assembly 38. In the system illustrated in FIG. 1 this function is served by a blower 46. However, this is only representative. In a turbine engine, for example, compressor discharge air would be employed.

Figure 2:
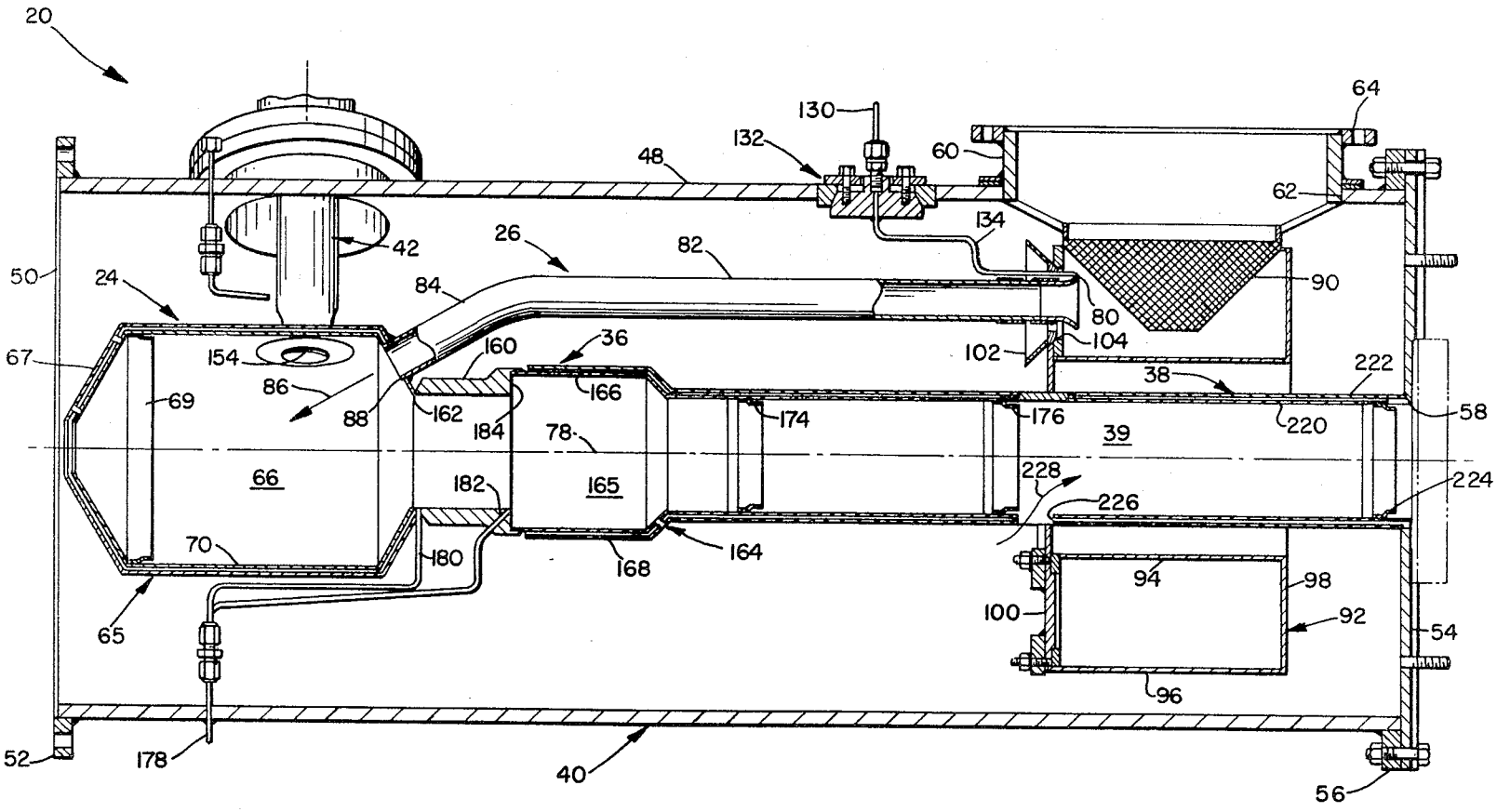
FIG. 2 is a longitudinal section through certain major components of the combustion apparatus illustrated in FIG. 1; the section is taken substantially along line 2—2 of FIG. 3.
Figure 3:
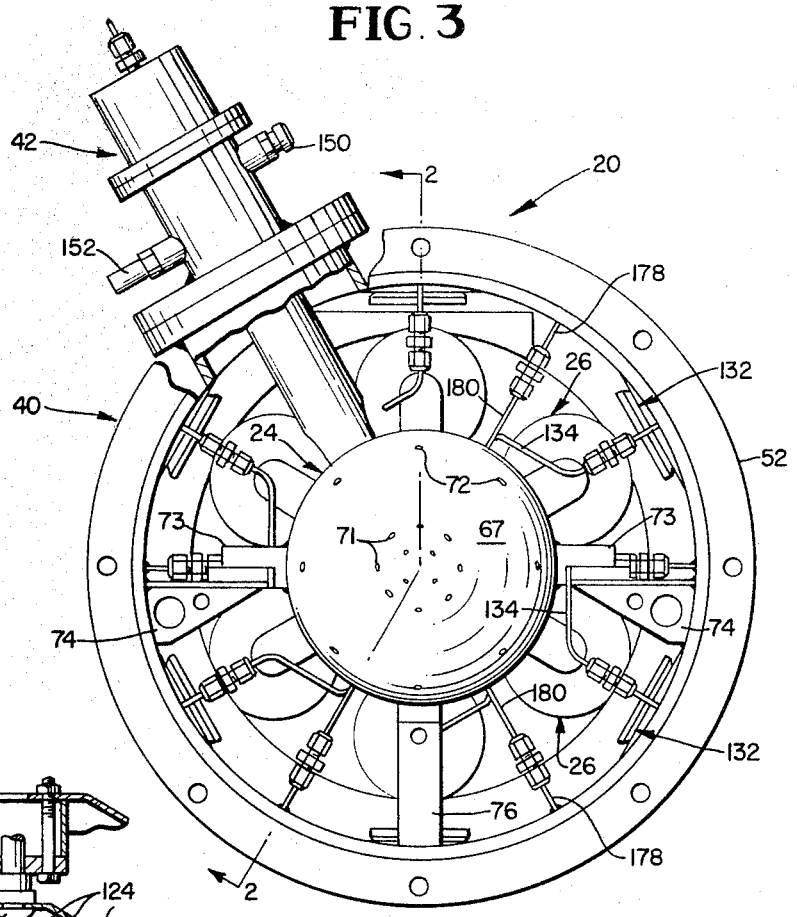
FIG. 3 is an end view of the combustion apparatus of FIG. 2.

Referring now to FIGS. 1-3, casing assembly 40 includes an elongated, cylindrical member 48 which is open at the upstream end 50 of combustion apparatus 20. The combustion apparatus can be coupled to the discharge of the air supply arrangement at that end of the casing assembly by an annular flange 52.

The downstream end of the casing assembly terminates in a cover 54 bolted to an annular flange 56 integrated with the cylindrical casing member 48. An exhaust opening 58, in which the downstream end of dilution zone liner assembly 38 terminates, is formed in the center of cover 54.

A second cylindrical casing member 60 is fixed to member 48 adjacent the downstream end of the latter. Communication between the two casing members is provided by aperture 62 in casing member 48.

An annular mounting flange 64 for precombustor 28 is provided at the outer end of casing member 60.

The jet induced circulation type main combustor 24, located at the upstream end of casing assembly 40, has a can type configuration. The combustor has a cylindrical, double walled liner 65 in which there is a primary combustion zone 66, a dome 67 at the upstream end of the liner, and a cooling strip 69 fixed to the inner wall 70 of liner 65.

Convective and splash cooling are employed to keep the main combustor from overheating. Cooling air is introduced through ports 71 and 72 in dome 67 and subsequently discharged into the combustor through ports (not shown) in the inner wall 70 of liner 65.

Main combustor 24, secondary combustor 36, and dilution zone liner assembly 38 are integrated into a single structure supported from outer casing assembly cover member 54 at its downstream end. The upstream end of the integrated structure is supported from the main, cylindrical member 48 of assembly 40 by lugs 73 which co-operate with casing mounted brackets 74 and by a radially extending mounting block 76 (see FIG. 3).

As shown in the same figure, the illustrated, exemplary combustion apparatus 20 has six tubular premixers 26 equiangularly spaced in an annular array around the axial centerline 78 of the combustion apparatus. Each of the premixers has an inlet 80 toward the downstream end of outer casing assembly 40, a section 82 extending parallel to the centerline 78 of the combustion apparatus, and a discharge section 84 which is inclined toward centerline 78 and the dome 67 of main combustor liner 65 as shown by arrow 86 in FIG. 2. The discharge section 84 of each premixer 26 terminates in an outlet 88 communicating with the interior of the main combustor.

As discussed above, precombustor 28 is provided to promote the vaporization of fuel in premixers 26 and thereby extend the range of fuels on which the combustion apparatus can be operated and/or the range of operating temperatures. In applications where the foregoing objectives are superfluous the precombustor can be omitted. In the latter case primary air flows directly from the interior of casing assembly 40 into the inlets 80 of the premixers.

With the precombustor 28 employed, heated air is discharged through casing member 60 and a perforated sheet metal member 90 into an annular scroll collector 92 surrounding dilution zone liner assembly 38. Collector 92 has a cylindrical inner wall 94, a concentric outer wall 96 to which member 90 is fixed, a downstream or rear wall 98, and an upstream or front wall 100. Those sections 82 of the premixers which are parallel to combustion apparatus centerline 78 extend through collars 102 and apertures 104 in collector front wall 100 into the interior of the collector to provide fluid communication between the latter and premixer inlets 80.

Figure 4:
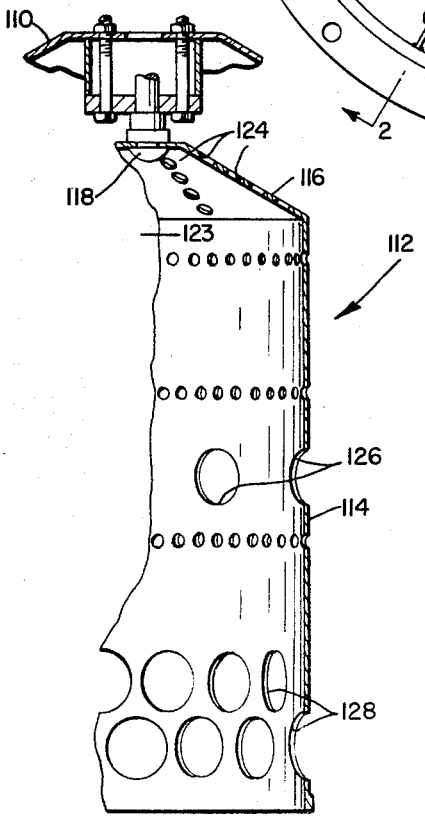
FIG. 4 is a partial, sectioned view showing in detail certain internal components of a precombustor incorporated in the combustion apparatus of FIG. 1.

Referring now primarily to FIGS. 1 and 4, precombustor 28 includes an outer casing assembly 106 composed of a cylindrical member 108 fixed to the mounting flange 64 of combustion apparatus casing assembly 40 and a dome 110 (see FIG. 1). Housed within and in spaced relation to assembly 106 is a liner 112 (see FIG. 4) having a cylindrical section 114 communicating at its lower, discharge end with the interior of collector 92 through member 90. At the opposite, upper end of the inner liner is a frustoconical dome 116 in which a fuel atmozier 118 is mounted.

Atomizer 118 is supplied with fuel through line 120 (see FIG. 1).

Combustion air for the precombustor flows from the interior of combustor apparatus assembly casing 40 into the passage 122 between precombustor casing assembly 106 and liner 112. Combustion air is introduced from passage 122 into the combustion zone 123 in liner 112 through apertures 124 in the dome of the liner. Additional air, constituting the primary air for main combustor 24, flows from passage 122 through apertures 126 and 128 into cylindrical liner section 114.

Figure 5:
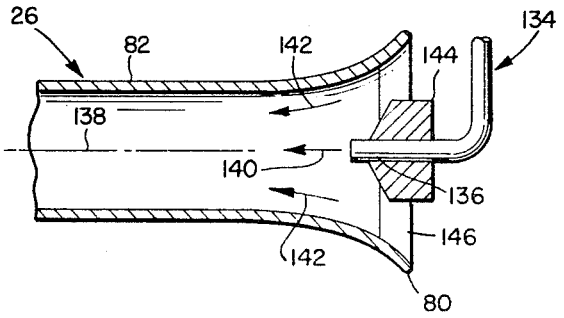
FIG. 5 is a partially schematic, longitudinal section through the upstream or inlet end of a premixer employed in combustion apparatus in accord with the principles of the present invention; the section is designed particularly to show the flow relationship between the air and fuel introduced into the premixer.

Referring now to FIGS. 1–3 and 5, fuel is injected into the inlet ends 80 of premixers 26 from fuel source 32 through an external fuel line system identified in FIG. 1 by reference character 130, connector assemblies 132, and internal fuel lines 134. As best shown in FIG. 5, the latter terminate in discharge or injection sections 136 which are concentric with the axial centerlines 138 of the premixer tube straight sections 82. Thus, the fuel is injected into the premixer in co-flowing relationship with the air supplied thereto as is shown by arrows 140 (fuel) and 142 (air). As discussed above, this is an important feature of the present invention as it eliminates the problems such as autoignition appurtenant to heretofore employed fuel injection schemes.

Each internal fuel line 134 is supported from the associated premixer 26 at the inlet 80 thereof by a plug 144 and radial struts 146.

During start-up only, the fuel-air mixture supplied to main combustor 24 from premixers 26 is ignited by torch igniter 42. Thereafter, the igniter is extinguished.

Ignitor 42 is supplied with fuel from fuel source 32 through a fuel line 148 (shown diagramatically in FIG. 1). Air is supplied through inlet 150 (see FIG. 3), and the fuel/air mixture is ignited by a conventional spark plug 152.

Ignitor 42 is mounted on the cylindrical, main member 48 of combustion apparatus casing assembly 40 and extends radially inward therefrom toward main combustor 24, communicating with the primary combustion zone 66 in the latter through an aperture 154.

The combustion processes in main combustor 24 proceed in accord with the jet induced circulation principles discussed above.

The secondary, wall stabilized, step combustor 36 downstream from main combustor 24 includes a cylindrical collar 160 communicating at its inlet or upstream end with a central aperture 162 in the discharge end of main combustor liner 65 and a liner assembly 164. The latter, which houses a secondary combustion zone 165, is composed of a tubular, inner member 166 abutting collar 160 and a concentric, outer member 168.

Figure 6:
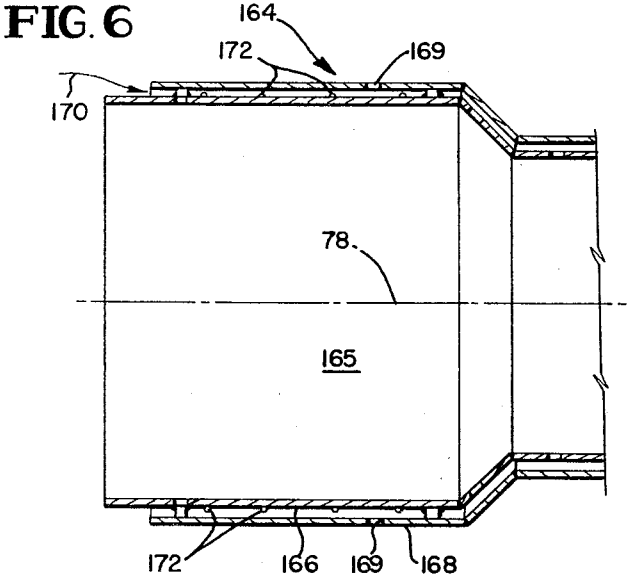
FIG. 6 is a portion of FIG. 2 to an enlarged scale, showing the details of a system for cooling a step burner incorporated in the combustion apparatus of FIG. 1.

The outer member has an open, upstream end and a series of apertures 169 around its circumference through which cooling air can flow into the annular passage between liner assembly members 166 and 168 as shown by arrow 170 in FIG. 6. Transfer of heat from inner member 166 to this cooling air by conduction is promoted by trip strips 172 fixed to the exterior of member 166 at longitudinally spaced locations therealong and by cooling strips 174 and 176.

Referring now to FIGS. 1–3, fuel is supplied to secondary combustor 36 from fuel supply 32 by external fuel line 178 and internal fuel lines 180 and 182. There are annular arrays of the latter with individual members of the arrays being located at equiangularly spaced locations around the secondary combustor (see FIG. 3).

Internal fuel lines 180 inject fuel into the upstream or inlet end of the secondary combustor while fuel lines 182 inject fuel directly into the step 184 of that combustor. As discussed above, this promotes the maintenance of those conditions in the secondary combustor which inhibit the formation of $NO_x$ therein.

Figure 7:
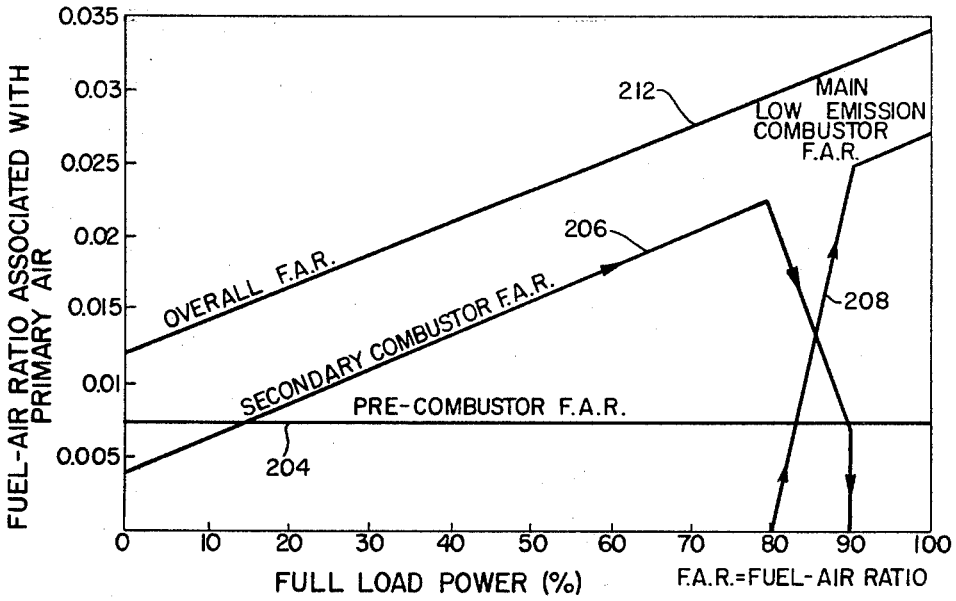
FIG. 7 is a graphical representation of one fuel-air schedule for combustion apparatus as shown in FIGS. 1 and 2.

Referring now to FIGS. 1 and 7, it was pointed out above that combustion apparatus 20 has two modes of operation, both capable of extending the operating range of jet induced circulation main combustor 24. In the first of these, both the main combustor 24 and the secondary combustor 36 are operated over the entire range of operation of the combustion apparatus. In the second mode of operation, secondary combustor 36 is employed as the main combustor until the load 22 on the combustion apparatus increases to a level (typically expressed as a percentage of full load) at which the $NO_x$ production reaches a maximum tolerable limit. At this level, low emission main combustor 24 is ignited and the rate of fuel supplied to the secondary combustor decreased or the combustor actually shut down to keep total emissions from combustion apparatus 20 within bounds.

The operation of the main and secondary combustors as well as that of precombustor 28 and igniter 42 is controlled by fuel scheduler 34 which will, for example, be of the microprocessor type. Because the details of the fuel scheduler are not part of the present invention and because the technology for a suitable microprocessor type controller is readily available (see, for example, Bibbero, Microprocessors in Instruments and Control, John Wiley & Son, Inc., Somerset, N.J., 1977), the details of the fuel scheduler will not be described herein.

Fuel scheduler 34 has an input 186 from load 22, an output 188 to valve 190 in main combustor fuel line 130, an output 192 to valve 194 in igniter fuel line 148, an output 196 to valve 197 in precombustor fuel line 120, and an output 198 to valve 200 in secondary combustor external fuel line 178.

An exemplary control schedule for staged, full range (0 to 100% of full load) operation in which secondary combustor 36 is used as the main combustor until a selected load level is reached and low emission combustor 24 is then brought on stream to keep emissions within acceptable limits is depicted graphically in FIG. 7. In this schedule precombustor 28 is operated continuously as shown by curve 204 while secondary combustor 36 is operated over the 0–90% of full load range as shown by curve 206 and main combustor 24 only over the 80–100% of that range as shown by curve 208. As shown by curve 212, this operating schedule is intended to produce an overall equivalence ratio of less than 0.035, and a corresponding low generation of $NO_x$, over 0–100% of the full load range of operation of combustion apparatus 20.

Referring again to FIG. 2, the combustion products generated in main combustor 24 and/or in secondary combustor 36 are discharged into the dilution zone 39 provided by assembly 38. That assembly includes a cylindrical inner member 220, a concentric outer tubular member 222, and a cooling strip 224 fixed to inner member 220 at the downstream end of the assembly.

Dilution air ports 226 are formed in assembly 38 around the upper end thereof. Dilution air flows into zone 39 through ports 226 from the interior of combustion apparatus casing assembly 40 as shown by arrow 288.

This part of combustion apparatus 20 functions in a conventional manner.

Figure 8:
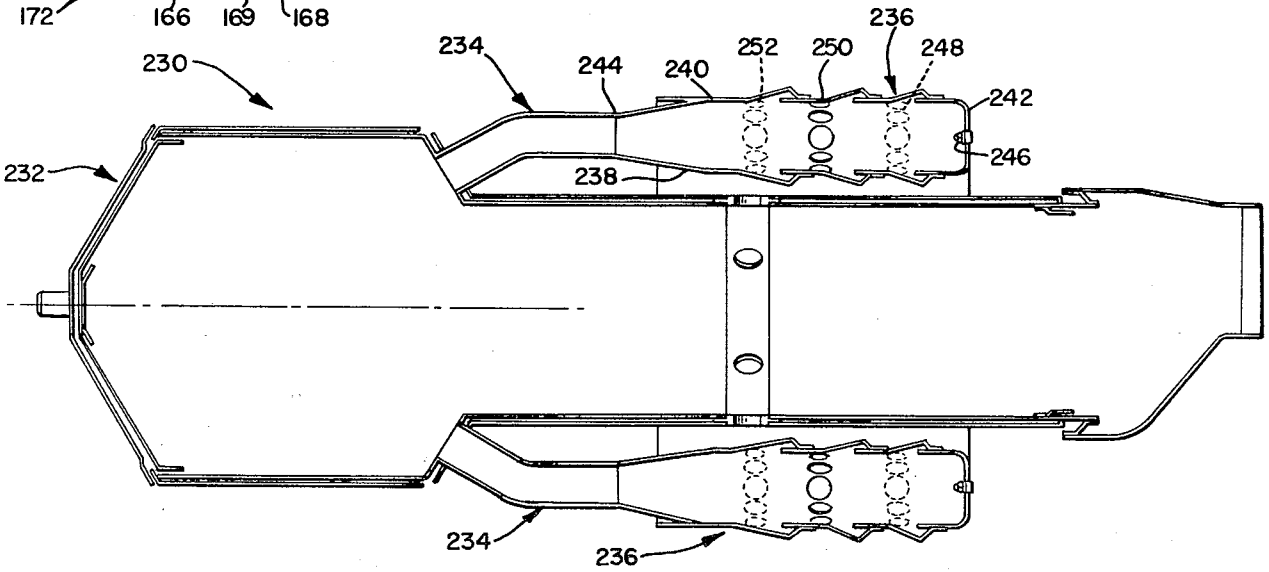
FIG. 8 illustrates an alternate form of precombustor for combustion apparatus in accord with the principles of the present invention.

The principles of the present invention need not necessarily be embodied in combustion apparatus physically resembling that discussed above. FIG. 8, for example, depicts combustion apparatus 230 in accord with the present invention which includes a primary or main combustor 232 of the jet induced circulation type as discussed above, premixers 234, and an annular rather than can type precombustor 236 for supplying heated air to premixers 234.

Precombustor 236 has concentric, annular, inner and outer liners 238 and 240 and an annular dome 242. The inlets 244 of premixers 234 communicate with the interior of the precombustor at the discharge end thereof opposite dome 242.

Fuel is injected into the precombustor through atomizers 246 mounted in dome 242 at intervals therearound. Combustion air is supplied through apertures 248 from the interior of a casing (not shown) surrounding the precombustor and main combustor 232, and the air to be heated is introduced through two sets of apertures 250 and 252.

Fuel for the main combustor can be injected into the premixers at locations generally coincident with the inlets 244 thereof or into precombustor 236 itself at locations generally coincident with air inlets or apertures 252.

Aside from the different type of precombustor, combustion apparatus 230 is essentially the same as that described above except for the omission of the secondary combustor, an option that is available when the advantages provided by the latter such as an extended operation range are not required.

Figure 9:
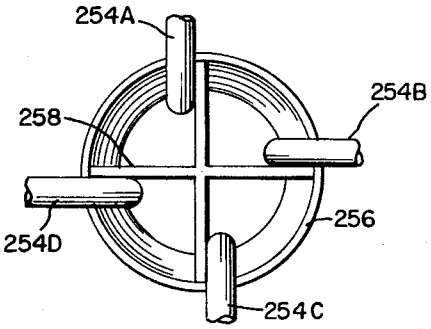
FIG. 9 is an end view of the premixer shown in FIG. 5 with an alternate arrangement for introducing fuel thereinto.

Referring again to the drawing, FIG. 9 depicts an alternate system for injecting fuel into the premixers of combustion apparatus in accord with the present invention in co-flow relationship with the air introduced thereinto.

The fuel supply system shown in FIG. 9 differs from the one illustrated in FIG. 5 in that four fuel lines 254A–D are employed to inject the fuel into the inlet end of premixer 256 at locations spaced at equal intervals around the premixer rather than at a single central location. This fuel injection system is designed to promote the initial vaporization of the fuel and to minimize variations in the equivalence ratio of the fuel/air mixture.

In the illustrated fuel supply system fuel lines 254A–D are supported from premixer 256 by a cruciform bracket 258. Other schemes for supporting the fuel lines can of course be employed.

It was pointed out above that, instead of employing a precombustor to heat primary air for the main combustor of combustion apparatus in accord with the present invention, hot gases bled off from the main combustor may be used for this purpose. Also, we indicated that fuel staging is preferably employed if this alternate scheme of heating the primary combustion air is used. Combustion apparatus incorporating both of the foregoing features is illustrated in FIGS. 10 and 11 in generally schematic form and identified by reference character 260.

Figure 10:
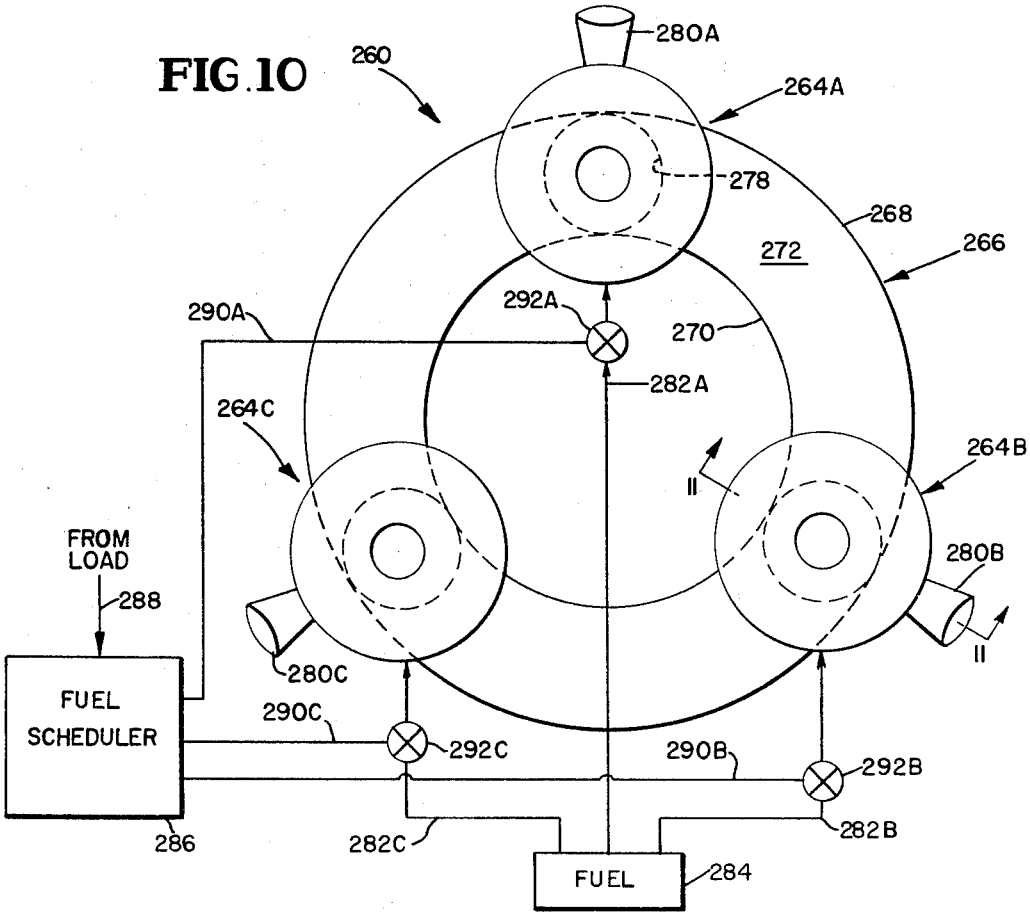
FIG. 10 is a primarily pictorial representation of combustion apparatus in accord with the principles of the present invention in which recirculation of gases from a primary combustion zone is utilized to promote fuel vaporization.
Figure 11:
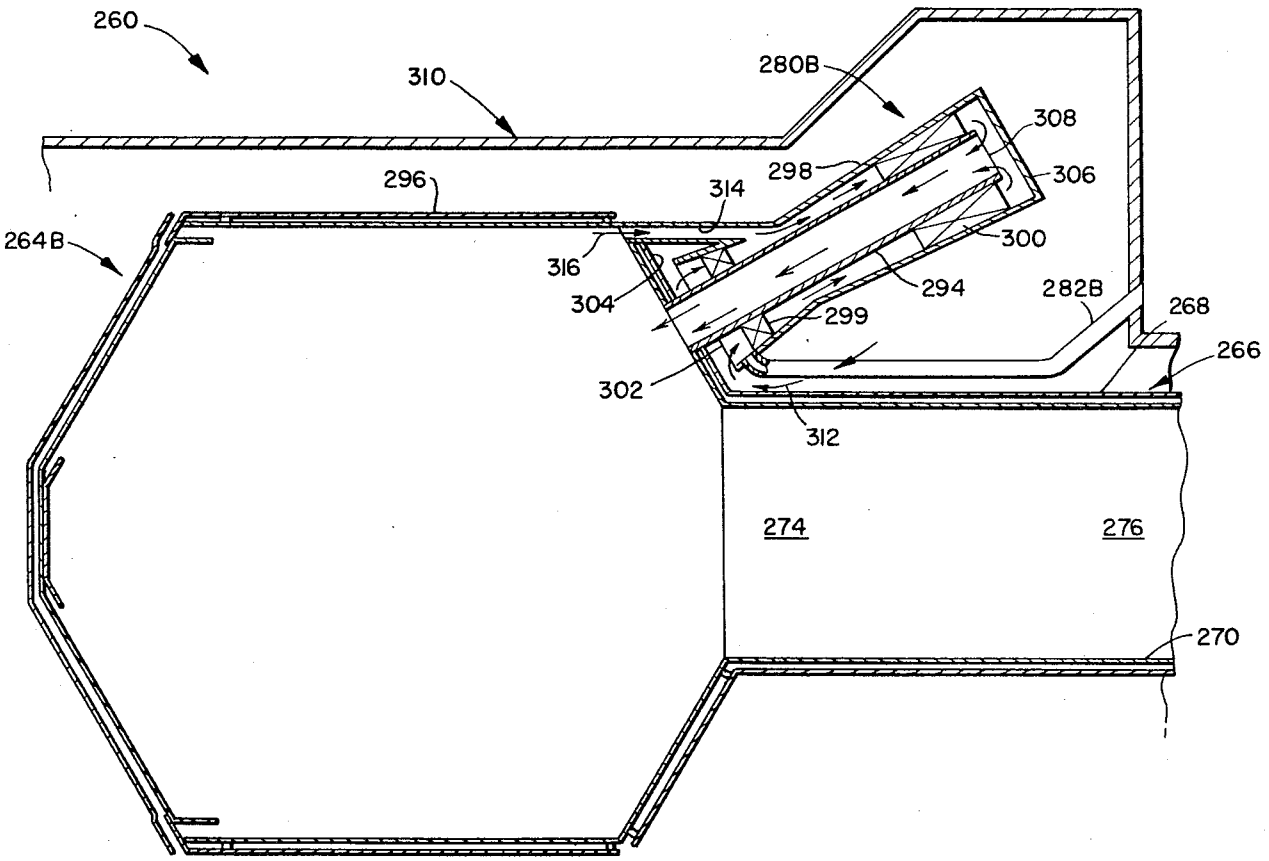
FIG. 11 is a partial section through the combustion apparatus of FIG. 10, taken substantially along line 11—11 of the latter figure.

As best shown in FIG. 10, combustion apparatus 260 has an annular array of three jet induced circulation primary or main combustors 264A–C which discharge into an annular assembly 266 having an outer wall 268, an inner wall 270, and a closure 272 spanning the outer and inner wall members at the upstream end of the assembly. Assembly 266 provides a secondary combustion zone 274 and a dilution zone 276 (see FIG. 11). Primary combustors 264A–C communicate with the interior of assembly 266 through apertures 278 in cover member or closure 272 of the latter.

As in the case of the embodiments of our invention discussed above, premixed fuel and air is supplied to each of the main combustors 264A–C through an annular array of premixer tubes. For the sake of convenience, only representative ones of the premixers, identified by reference characters 280A–C, are shown in FIG. 10.

Fuel is supplied to the premixers through fuel lines identified generally by reference characters 282A–C from fuel supply 284. The flow of fuel to the premixers is regulated by a fuel scheduler 286 of the type discussed above. It has a load input 288 and outputs 290A–C to valves 292A–C in fuel lines 282A–C, respectively.

In the preferred mode of operation, fuel scheduler 286 so regulates the supply of fuel to the premixers of the three primary combustors that only one of the latter is in operation at low load levels. As the load on combustion apparatus 260 increases and the equivalence ratio of the operating combustor approaches the level at which $NO_x$ emissions are at the permitted maximum, fuel is staged to a second of the combustors, this process being repeated until, under full load, all of the main combustors are operating.

Referring now primarily to FIG. 11, each of the premixers of combustion apparatus 260 includes an inner tube 294 communicating with the interior of the associated primary combustor through the outer wall 296 of the latter and an outer tube 298 from which the inner tube is supported by two series of annular struts 299 and 300. The outer tube 298 of the premixer has an inlet 302 spaced from the inclined section 304 of primary combustor outer wall 296 at the downstream end thereof. The opposite end of the outer member is closed by a cover component 306 spaced from the inlet 308 of inner tube 294.

Air is introduced into the inlet 302 of outer tube 298 from the interior of combustion apparatus outer casing assembly 310 as shown by arrow 312. Fuel is injected from fuel line 282B into co-flow relationship with the air in the manner discussed above in conjunction with FIG. 5. Hot gases are injected into outer premixer tube 298 through a hot gas bleed port 314 as shown by arrow 316.

The hot gases, air, and fuel flow through tube 298, reverse direction, flow through inner tube 294, and exit into the main combustor. This reverse flow premixer configuration is designed to promote complete vaporization of the fuel and uniform mixing of the latter with the primary combustion air supplied to the premixer.

Numerous embodiments of our invention in addition to those described above are contemplated. For example, an annular instead of a can type of jet induced circulation main combustor may be employed. Consequently, the selection of the above-described embodiments for inclusion herein is not in any way intended to limit the scope of our invention as defined in those claims which follow hereinafter. That is, the invention may be embodied in other specific forms without departing from the spirit or essential characteristics thereof. The present embodiments are therefore to be considered in all respects as illustrative and not restrictive, the scope of the invention being indicated by the appended claims rather than by the foregoing description; and all changes which come within the meaning and range of equivalency of the claims are therefore intended to be embraced therein.

What is claimed and described to be secured by Letters Patent is:

1. Combustion apparatus of the premix/fuel lean type, comprising: means providing an annular array of primary combustion zones of circular cross section and independently activatable means for so introducing jets of a premixed combination of fuel and primary air having an equivalence ratio of less than unity into each of said primary combustion zones at intervals therearound and toward the axial centerline of the primary combustion zone at the upstream end thereof as to effect recirculation of fluid in the primary combustion zone at a volume rate exceeding that at which the fuel and air are introduced into the primary combustion zone, whereby the temperature and the concentration of oxygen in said main primary combustion zone can be kept at levels that inhibit the formation of $NO_x$; and means providing an annular secondary combustion zone downstream from and communicating with all of said primary combustion zones, whereby the output of said apparatus can be varied to accommodate the load thereon by varying the number of primary combustion zones which are operational, the means providing said secondary combustion zone comprising concentric inner and outer liners and a closure means spanning said liners at the upstream end of said secondary combustion zone, said primary combustion zones being communicated with said secondary combustion zones through said closure means and the diameter of each said primary zone being greater than the radial dimension of the secondary combustion zone, whereby there is a step between each said primary zone and the secondary combustion zone at the location where those zones communicate with each other.

2. Combustion apparatus as defined in claim 1 which also comprises a premixer means for supplying premixed air and fuel to said primary combustion zones; means for supplying fuel and primary air to said premixer means; and means for heating the primary air supplied to each said premixer means to promote the vaporization of the fuel supplied to the premixer means comprising means for bleeding heated fluid from the primary combustion zone associated therewith into each of said premixer means and for then first entraining the fuel and heated gases in the primary air and subsequently circulating the mixture thus formed in a counterflow heat transfer relationship to said heated gases.

3. Combustion apparatus of the premix/fuel lean type, comprising: a main combustor means providing a plurality of primary combustion zones; a separate premixer means for forming a mixture of fuel and air having an equivalence ratio of less than unity and for so introducing jets of said mixture into each of said main combustion zones at intervals therearound and toward the axial centerline of said main combustion zones at the upstream ends thereof as to effect recirculation of fluid in said main combustion zones at a volume rate exceeding that at which the fuel and air are introduced into said main combustor means, whereby the temperature and the concentration of oxygen in each said main combustion zone can be kept at a level that inhibits the formation of $NO_x$; and a secondary combustor means downstream of and in fluid communication with said main combustor means, said secondary combustor means comprising concentric inner and outer liners and a closure means spanning said liners at the upstream end of said secondary combustor means, said primary combustion zones being communicated with said secondary combustor means through said closure means.

4. Combustion apparatus as defined in claim 3 which also comprises means for utilizing heated gases bled from said main combustor means to said premixer means to heat said air and to vaporize said fuel, thereby extending the range of fuels on which said combustion apparatus can be operated and/or lowering the temperature at which said apparatus can be operated on a given fuel, the means for utilizing said heated gases as aforesaid being means comprised at least in part of said premixer means for first entraining the fuel and heated gases in the air and then circulating the mixture thus formed in a counterflow heat transfer relationship to said heated gases.

5. Combustion apparatus as defined in claim 4 or in claim 3 wherein said premixer means comprising a plurality of premixers spaced in an annular array around the exterior of said main combustor means, each said premixer comprising: an inner member of tubular configuration having an outlet communicating with the interior of the main combustor means and an outlet located exteriorly of said main combustion means and a casing means surrounding said inner member and forming a passage therebetween, said casing means having a closed end spaced from the inlet of the inner member and an inlet adjacent the exterior of the main combustion means and said apparatus further including means via which primary air can flow into the inlets of the premixer casing means and through the passages between the casing means and the inner premixer members to the inlets of said inner members and means providing fluid communication between said passages and the interior of the main combustion means toward the inlet ends of said outer casing means.

6. Combustion apparatus as defined in claim 5 which further comprises means for introducing fuel into said premixer passages at locations adjacent the inlet ends of the outer casing means of the premixers.

7. Combustion apparatus as defined in claim 3 together with means for individually scheduling the supply of fuel to each of said premixer means, whereby the number of zones in which heat is being generated can be correlated to the load on the combustion apparatus.

* * * * *

UNITED STATES PATENT AND TRADEMARK OFFICE

CERTIFICATE OF CORRECTION

PATENT NO. : 4,351,156

DATED : September 28, 1982

INVENTOR(S) : DAVID J. WHITE ET AL

It is certified that error appears in the above-identified patent and that said Letters Patent is hereby corrected as shown below:

On the title page:

Change the name of the Assignee from "International Harvester Company"

to

--Solar Turbines Incorporated--

Signed and Sealed this

*Twenty-eighth* Day of *June 1983*

[SEAL]

*Attest:*

GERALD J. MOSSINGHOFF

*Attesting Officer*

*Commissioner of Patents and Trademarks*